US005209574A

United States Patent [19]

Tilman

[11] Patent Number: 5,209,574

[45] Date of Patent: May 11, 1993

[54] RECLOSABLE PLASTIC BAG WITH SLIDERLESS ZIPPER

[75] Inventor: Paul A. Tilman, New City, N.Y.

[73] Assignee: Minigrip, Inc., Orangeburg, N.Y.

[21] Appl. No.: 797,464

[22] Filed: Nov. 22, 1991

[51] Int. Cl.[5] ..... B65D 33/16

[52] U.S. Cl. ..... 383/63; 383/65; 383/35; 24/587

[58] Field of Search ..... 383/35, 63, 65; 24/576, 24/587, 588

[56] References Cited

U.S. PATENT DOCUMENTS

| | | | |
|---|---|---|---|
| 4,363,345 | 12/1982 | Scheibner | 383/65 X |
| 4,755,248 | 7/1988 | Geiger et al. | 24/587 X |
| 4,796,300 | 1/1989 | Branson | 24/587 X |
| 4,929,487 | 5/1990 | Tilman et al. | 383/63 X |
| 5,067,822 | 11/1991 | Wirth et al. | 383/63 X |
| 5,092,684 | 3/1992 | Weeks | 383/63 X |

FOREIGN PATENT DOCUMENTS

| | | | |
|---|---|---|---|
| 89680 | 9/1983 | European Pat. Off. | 383/65 |
| 398731 | 11/1990 | European Pat. Off. | 383/65 |
| 2008538 | 6/1979 | United Kingdom | 383/63 |

*Primary Examiner*—Allan N. Shoap
*Assistant Examiner*—Jes F. Pascua
*Attorney, Agent, or Firm*—Kane, Dalsimer, Sullivan, Kurucz, Levy, Eisele and Richard

[57] ABSTRACT

A reclosable bag is formed with profiles on internal surfaces of the bag walls defining a closure. Gripping ribs are formed between the profiles and the bag mouth to facilitate opening the bag. Finger guide ribs provided opposite the profiles to facilitate closing the bag.

9 Claims, 2 Drawing Sheets

RECLOSABLE PLASTIC BAG WITH SLIDERLESS ZIPPER

RELATED APPLICATIONS

The subject matter of the present application is related to application Ser. No. 07/797,461 filed on even date herewith, entitled CLOSURE FOR SLIDERLESS ZIPPER BAGS.

BACKGROUND OF THE INVENTION

A. Field of Invention

This invention pertains to the art of extruded reclosable bags and more particularly to a reclosable bag having fastener profiles with finger guides for interlocking the profiles and improved gripping ribs spaced from the profiles for gripping the bag mouth during opening.

B. Description of the Prior Art

Reclosable bags used for example for storing household goods are typically made of polyethylene. As shown in U.S. Pat. No. 3,416,199 to Imamura commonly assigned with the present invention, a reclosable bag may be formed of two opposed walls equipped at the mouth with fastener profiles. These profiles include a male profile attached to one wall and a female profile on the other wall. The profiles are shaped so that when they are aligned and pressed together into an engaging relationship they form a continuous closure for the bag. The bag may be opened by pulling the walls apart thereby separating the profiles. Various geometric shapes and arrangements for such profiles are shown in U.S. Pat. Nos. Re. 28,969; 3,338,285; 4,212,337; 4,363,345; 4,561,108; and 4,812,056. In addition, U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on an outside surface of the bag wall. European Patent Application 0 220 476 discloses a reclosable bag with several parallel symmetrical ridges disposed in parallel between the mouth of the bag and the closure profiles. U.S. Pat. No. 5,009,828 discloses a reclosable container with a grip strip.

One problem with the prior art reclosable bags is that they do not provide sufficient means for gripping the side walls of the bags to separate the profiles. This problem is especially prominent for example if the bag and/or the fingers of the user are wet because this wetness makes the polyethylene bag very slippery. A further problem is that it is difficult to close such bags particularly when the bags are relatively long since the fingers of the user may drift off the profiles resulting in the closing pressure not being directly applied to the closures.

SUMMARY OF THE INVENTION

In view of the above, an objective of the present invention is to provide a reclosable bag with improved gripping means whereby the ends of the bag can be grasped easily and firmly thereby separating the profiles.

A further objective is to provide a reclosable bag with guide means which guide the fingers of the user when closing the bag whereby the bag can be easily and securely closed.

Other objectives and advantages of the invention shall become apparent from the following description.

A reclosable bag constructed in accordance with this invention includes a front wall and a back wall joined along three edges to form an enclosure with a mouth defined by wall edges and profile means for selectively opening and closing the mouth. In addition the bag is provided with gripping means for separating the walls. The gripping means being disposed between the profiles and the mouth defining edges, and including first gripping ribs disposed on the front wall and second ribs disposed on the rear wall. The first and second ribs are inclined toward the profile means. The bag may also include guide means disposed adjacent to said profile means for guiding a user's fingers along said profile means.

DETAILED DESCRIPTION OF THE INVENTION

Figure 2:
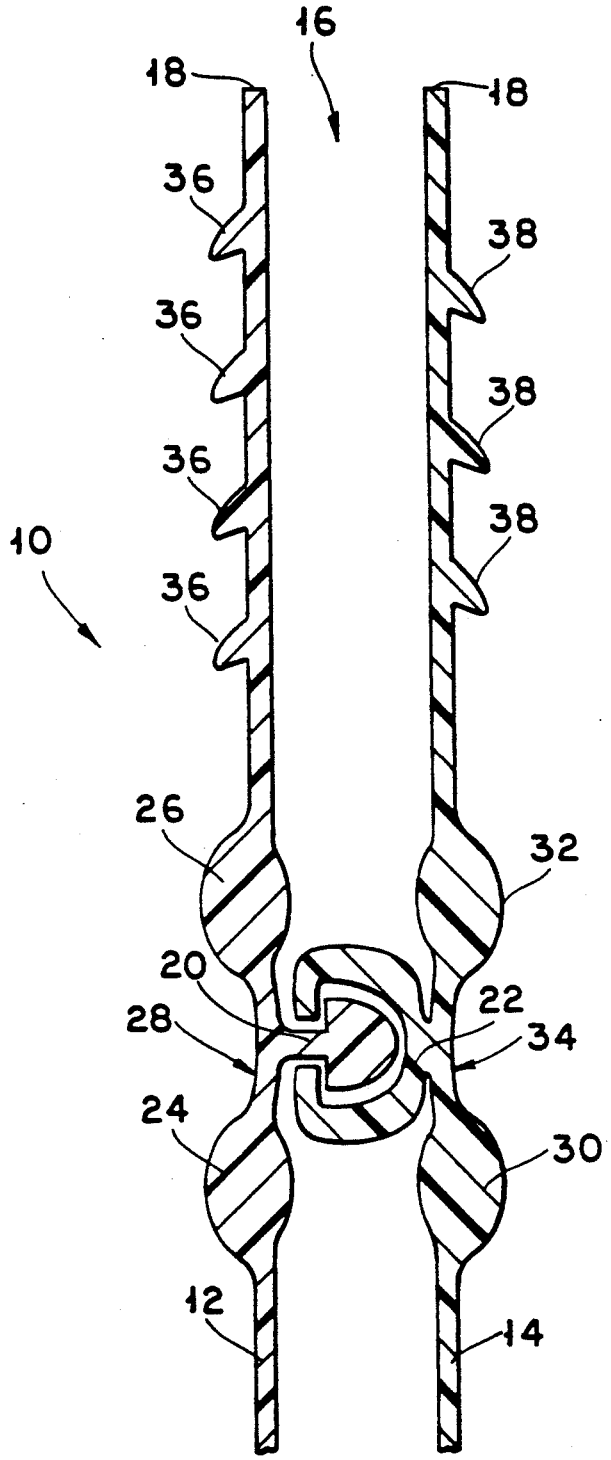
FIG. 2 shows an enlarged side sectional view of the bag opening.

Referring now to the drawings, a reclosable bag 10 constructed in accordance with this invention includes front and rear walls 12, 14 seamed along three edges thereby forming an enclosure with an opening or mouth 16 along the fourth edge 18. The bag 10 is preferably made of a plastic material by extrusion. Attached to internal surface of walls 12 and 14 are male and female profiles 20, 22 respectively which close the opening 16 when they are interlocked as shown in FIG. 2.

On the outside of wall 12 two ribs 24, 26 are provided, one on each side of male profile 20 to define a valley 28 therebetween disposed above male profile 20. Similarly, on the outside of wall 14 two ribs 30, 32 are formed, one on each side of female profile 22 to define a valley 34 disposed below female profile 22. Valleys 28 and 34 are sized and shaped to act as finger guides for the end user of the bag 10. As the user engages the profiles between his fingers, his fingers tend to ride in the valleys thereby maintaining a position over the profiles for forcing the profiles 20, 22 together to insure that the profiles interlock properly across the entire width of the bag.

Spaced between male profile 20 and opening 16, wall 12 is provided with a plurality of generally triangular gripping ribs 36. Similar ribs 38 are formed on wall 14. Importantly, ribs 36, 38 are angled or oriented towards the profiles 20, 22 respectively. Preferably ribs 36 are offset from the ribs 38 to accommodate any offset that may occur between the fingers of a user when opening the bag.

Figure 1:
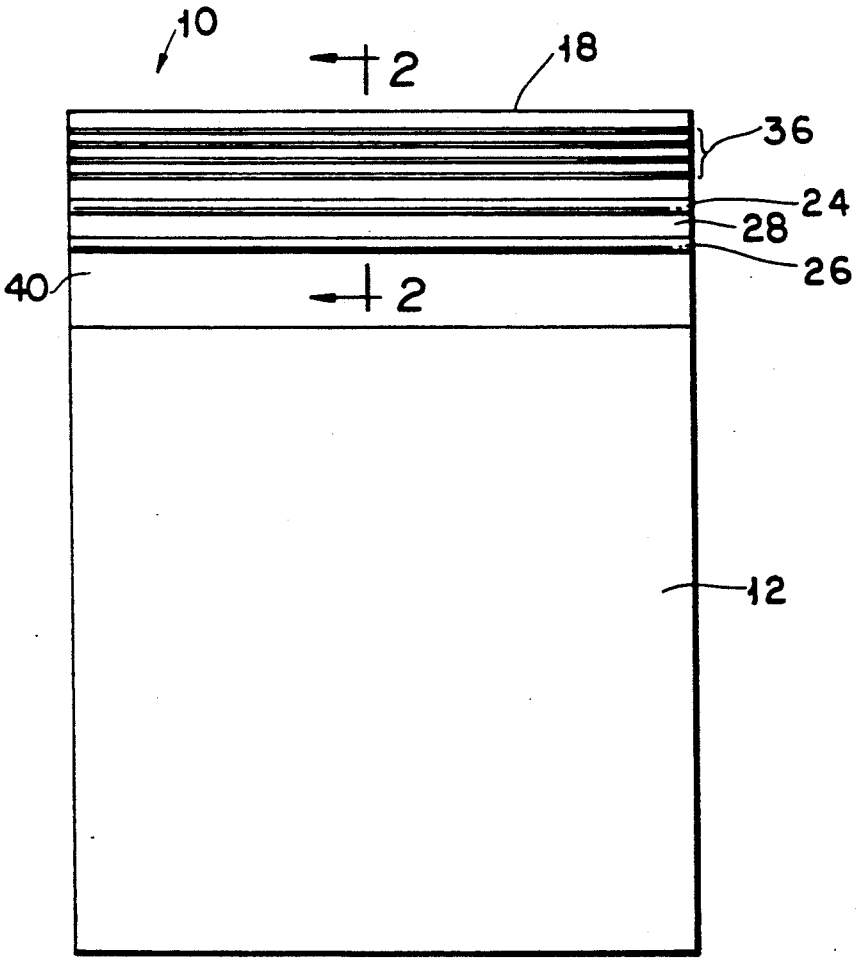
FIG. 1 shows a plan view of a reclosable bag constructed in accordance with the invention.

Bag 10 may be formed unitarily for example by extruding the walls of the bag 12, 14, the profiles 20, 22, and the ribs 24, 26, 30, 32, 36 and 38 simultaneously. Alternatively the profiles and the guiding ribs and/or gripping ribs may be extruded in the form of a strip or ribbon 40 and joined to the bag walls as shown in FIG. 1.

Obviously numerous modifications may be made to this invention without departing from their scope as defined in the appended claims.

I claim:

1. A reclosable bag comprising:

a front wall and a rear wall joined to form an enclosure with a mouth defined by top edges of said walls;

a pair of interlocking profiles on internal surfaces of said walls for selectively locking said front and rear walls together to prevent or permit opening and closing said mouth; and guide means disposed on external surfaces of said walls for guiding fingers of a user to remain in a position aligned with said profiles, said guide means including a first pair of guide ribs disposed on said front wall straddling one of said profiles and a second pair of guide ribs disposed on said rear wall straddling the other of said profiles.

2. The reclosable bag of claim 1 including a first plurality of ribs disposed on said first wall and a second plurality of ribs disposed on said second wall.

3. The reclosable bag of claim 1 further comprising guide means disposed on external surfaces of said walls for guiding fingers of a user to remain in a position aligned with said profiles.

4. The reclosable bag of claim 3 wherein said guide means includes a first pair of guide ribs disposed on said front wall and a second pair of guide ribs disposed on said rear wall.

5. The reclosable bag of claim 1 wherein said first pair of guide ribs includes a guide rib disposed above said male profile and a guide rib disposed below said male profile defining therebetween a finger guiding valley behind said male profile.

6. The reclosable bag of claim 5 wherein said second pair of guide ribs includes a guide rib disposed above said female profile and a guide rib disposed below said female profile defining therebetween a finger guiding valley behind said female profile.

7. The reclosable bag of claim 1 wherein said profiles means are disposed on a ribbon, said ribbon being attached to said walls.

8. The reclosable bag of claim 1 wherein said profiles means, guide ribs and gripping ribs are formed unitarily with said walls.

9. The reclosable bag of claim 1 further comprising:

gripping ribs disposed between said profiles and said wall top edges, said gripping means including at least a first gripping rib disposed on said front wall and at least a second gripping rib disposed on said rear wall, said first and second ribs being inclined from normals to the planes of said walls toward said profiles.

* * * * *